US009194543B2

(12) United States Patent
Hoffmann et al.

(10) Patent No.: US 9,194,543 B2
(45) Date of Patent: Nov. 24, 2015

(54) FLOODLIGHT COMPRISING LIGHT-EMITTING DIODES

(75) Inventors: Helge Hoffmann, Voehringen (DE); Hans-Ulrich Tobuschat, Blaustein (DE)

(73) Assignee: JB-Lighting Lichtanlagentechnik GmbH, Blaustein (DE)

( * ) Notice: Subject to any disclaimer, the term of this patent is extended or adjusted under 35 U.S.C. 154(b) by 0 days.

(21) Appl. No.: 14/009,881

(22) PCT Filed: Apr. 5, 2012

(86) PCT No.: PCT/EP2012/056305

§ 371 (c)(1),
(2), (4) Date: Nov. 13, 2013

(87) PCT Pub. No.: WO2012/136779

PCT Pub. Date: Oct. 11, 2012

(65) Prior Publication Data

US 2014/0146535 A1 May 29, 2014

(30) Foreign Application Priority Data

Apr. 5, 2011 (DE) ..... 10 2011 001 802
Sep. 12, 2011 (DE) ..... 10 2011 053 490
Sep. 12, 2011 (DE) ..... 10 2011 053 493

(51) Int. Cl.

| | |
|---|---|
| ***H01R 33/00*** | (2006.01) |
| ***F21V 21/00*** | (2006.01) |
| ***F21S 4/00*** | (2006.01) |
| ***F21K 99/00*** | (2010.01) |
| ***F21V 19/00*** | (2006.01) |
| *F21Y 101/02* | (2006.01) |

(52) U.S. Cl.
CPC ..... *F21K 9/30* (2013.01); *F21V 19/004* (2013.01); *F21Y 2101/02* (2013.01)

(58) Field of Classification Search
CPC ..... F21K 9/30; F21V 19/004; F21Y 2101/02
See application file for complete search history.

(56) References Cited

U.S. PATENT DOCUMENTS 6,428,189 B1 * 8/2002 Hochstein ..... 362/373
7,290,913 B2 11/2007 Watanabe et al.

(Continued)

FOREIGN PATENT DOCUMENTS

EP 1 630 474 A2 3/2006
EP 2 302 985 A1 3/2011
JP 2003 068130 A 3/2003

OTHER PUBLICATIONS

International Search Report of PCT/EP2012/056305, dated Jul. 30, 2012.

(Continued)

*Primary Examiner* — Donald Raleigh
(74) *Attorney, Agent, or Firm* — Collard & Roe, P.C.

(57) ABSTRACT

A floodlight having a plurality of light-emitting diode arrangements which are arranged on a light-emitting surface on the front face of a support plate so as to be laterally spaced from one another. The light-emitting diode arrangements are retained directly or indirectly on the support plate by mechanically releasable retaining elements which can be actuated without tools. The retaining elements are designed such that the retaining elements can be actuated from the front face of the support plate, and the light-emitting diode arrangements can be removed from the front face of the support plate when the retaining elements are in the released position. At the same time, the retaining means press the light-emitting diode arrangements onto a heat sink arrangement in a retaining position in order to ensure a good heat transfer between the light-emitting diode arrangements and the heat sink arrangement.

25 Claims, 5 Drawing Sheets

(56) References Cited

U.S. PATENT DOCUMENTS

Figure 1:
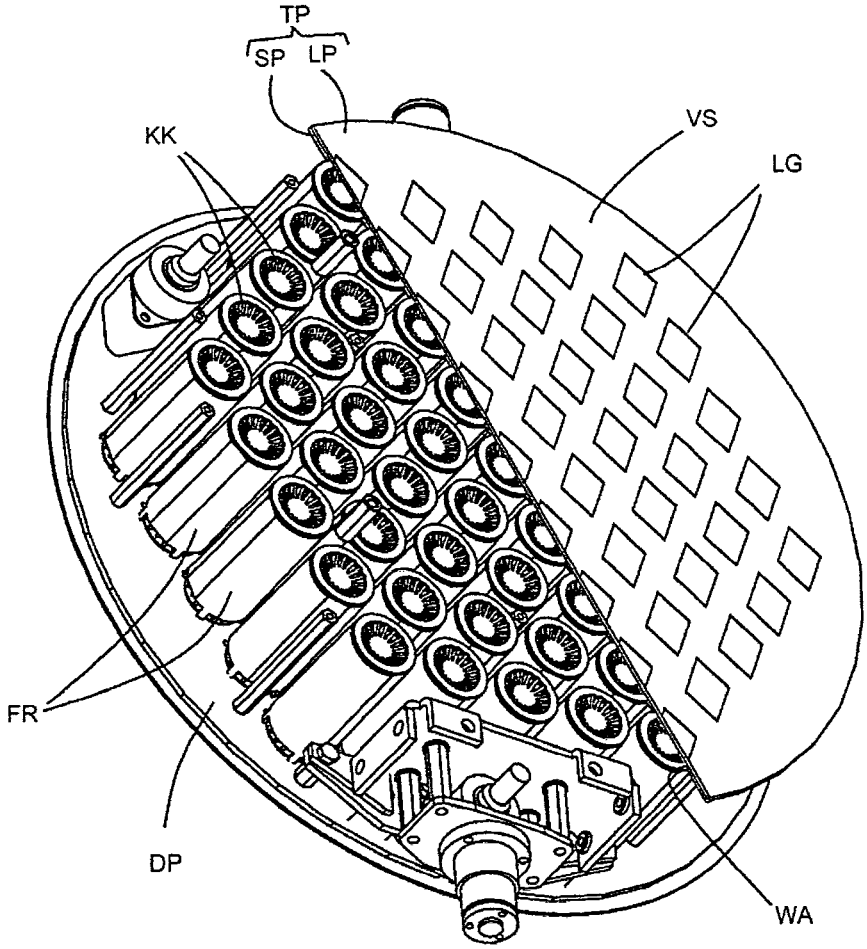

2005/0207165 A1* 9/2005 Shimizu et al. ..... 362/362
2010/0128478 A1* 5/2010 Anderson ..... 362/249.02
2011/0037412 A1* 2/2011 Kim ..... 315/294
2012/0051065 A1* 3/2012 Daily et al. ..... 362/311.02

OTHER PUBLICATIONS

International Preliminary Report on Patentability of PCT/EP2012/056305, dated Oct. 8, 2013.

* cited by examiner

Fig. 4
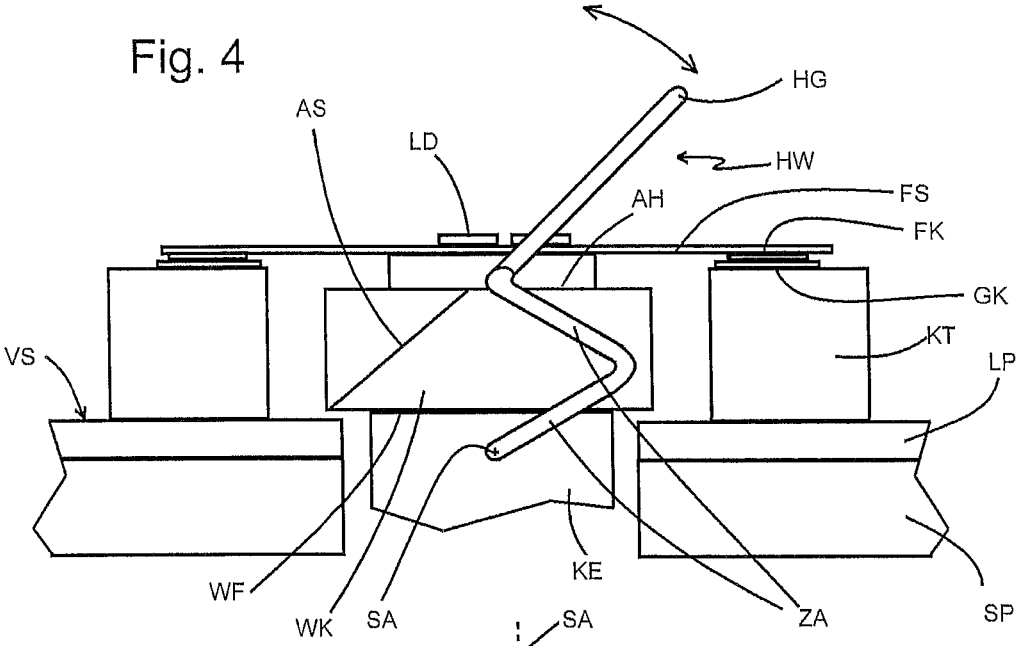
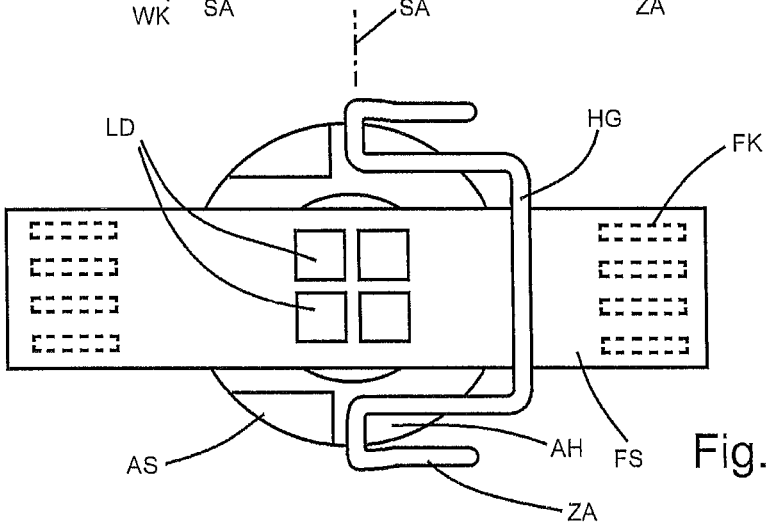
Fig. 5
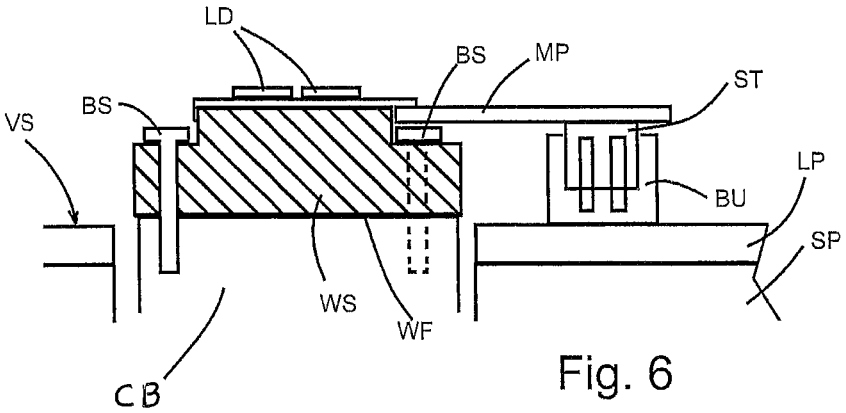
Fig. 6

FLOODLIGHT COMPRISING LIGHT-EMITTING DIODES

CROSS REFERENCE TO RELATED APPLICATIONS

This application is the National Stage of PCT/EP2012/056305 filed on Apr. 5, 2012, which claims priority under 35 U.S.C. §119 of German Application No. 10 2011 001 802.6 filed on Apr. 5, 2011, German Application No. 10 2011 053 493.8 filed on Sep. 12, 2011, and German Application No. 10 2011 053 490.3 filed on Sep. 12, 2011, the disclosures of which are incorporated by reference. The international application under PCT article 21(2) was not published in English.

The invention relates to a floodlight with a large number of light-emitting diodes arranged in light-emitting diode arrangements.

Floodlights, for example for stage lighting, especially so-called wash lights or projectors, are also used with light-emitting diodes as light sources, wherein a large number of light-emitting diode arrangements is arranged distributed over a surface because of the small light power of individual light-emitting diodes. The light-emitting diode arrangements, each of which may also contain several light-emitting diodes, are arranged spaced apart from one another on a carrier plate common for several or preferably for all light-emitting diode arrangements. The carrier plate may in particular contain a printed-circuit board with conductor tracks for activation of the light-emitting diodes.

The high-power light-emitting diodes used in such floodlights possess an average lifetime that makes the replacement of at least one of the light-emitting diodes probable over the useful life of the floodlight.

The present invention is based on the task of specifying a floodlight of the said type with advantageous handling for a replacement of a light-emitting diode arrangement.

The invention is described in claim 1. The dependent claims contain advantageous configurations and improvements of the invention.

By an arrangement of the light-emitting diodes in light-emitting diode arrangements with one or some, preferably not more than six, especially not more than four light-emitting diodes on an intermediate carrier circuit board, the fastening of the light-emitting diode arrangement with a common printed-circuit board via mechanically detachable holding means and the solder-free electrical contacting of the light-emitting diodes with conductor tracks of the common printed-circuit board, a replacement of a defective light-emitting diode arrangement in an advantageous and inexpensive structure of printed-circuit board and light-emitting diode arrangements is possible in advantageously simple manner.

By the preferred removal capability of the light-emitting diode arrangements from the front side of the carrier plate, only the cover of the lighting panel, which in particular contains a transparent pane and typically a lens arrangement, need be removed, without requiring access from the rear side of the carrier plate. By the retention of the light-emitting diodes on the carrier plate by means of mechanical holding means that can be actuated from the front side of the carrier plate, the replacement can be accomplished particularly simply. In particular, no soldering or cementing of the light-emitting diode arrangements with the carrier plate is provided, so that for release of the light-emitting diode arrangements only the respective associated mechanical holding means must be shifted from a holding position into a releasing position. The front side of the printed-circuit board is to be understood as the side of the printed-circuit board assigned to the light emission of the floodlight. In an advantageous embodiment, the holding means can be actuated manually without tools. In another advantageous embodiment, the holding means can contain screws, which can be loosened for removal or attachment of a light-emitting diode arrangement and by means of which a particularly stable connection between light-emitting diode arrangement and printed-circuit board is possible directly or via other elements of the floodlight structure.

Advantageously the electrical contacting of the light-emitting diodes of the light-emitting diode arrangements with conductor tracks of the common printed-circuit board is achieved via solder-free and cement-free contact arrangements, such as, for example, plug contacts or press-on contacts, the corresponding contact elements of which are attached directly without cables to the respective printed-circuit board or to the intermediate carrier circuit boards.

Advantageously a cooling-body arrangement, with which the light-emitting diode arrangements are connected highly thermally conductively, is provided on the rear side of the printed-circuit board facing away from the light-emitting diode arrangements. The highly thermally conducting connection is achieved advantageously by holes through the printed-circuit board. The holding means act advantageously between cooling-element arrangement and light-emitting diode arrangements, so that the light-emitting diode arrangements are held against the cooling-body arrangement, which in turn, via the mechanical structure of the floodlight, stands in well-defined position relative to the printed-circuit board. The holding means may be advantageously held captively on the cooling body arrangement. The connection of the light-emitting diode arrangements by means of the holding means advantageously also brings about a pressing-on of oppositely disposed thermal contact faces of light-emitting diode arrangements and cooling-body arrangement, accompanied by elastic bracing by the holding means and thereby a good thermal contact without soldering of the light-emitting diode arrangements with the cooling-body arrangement. Advantageously a thin deformable thermally conducting layer, especially a thermally conducting foil, which assures good, large-area heat transfer even in the case of small irregularities of the thermal contact faces, may be interposed between the oppositely disposed thermal contact faces.

The cooling-body arrangement may contain a cooling plate resting with its surface on the rear side of the printed-circuit board as a cooling body common for all light-emitting diode arrangements. The cooling plate may also serve at the same time as a bracing plate for mechanical stabilization.

Preferably the cooling-body arrangement contains a large number of cooling bodies, each of which is associated individually with the light-emitting diode arrangements and are connected highly thermally conductively with these and by means of the holding means.

Figure 2:
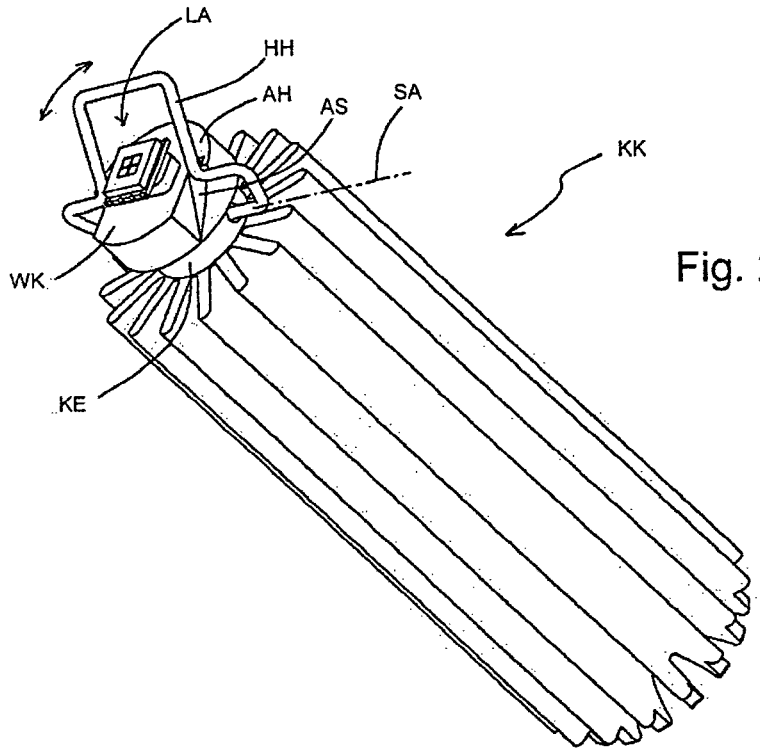
Figure 3:
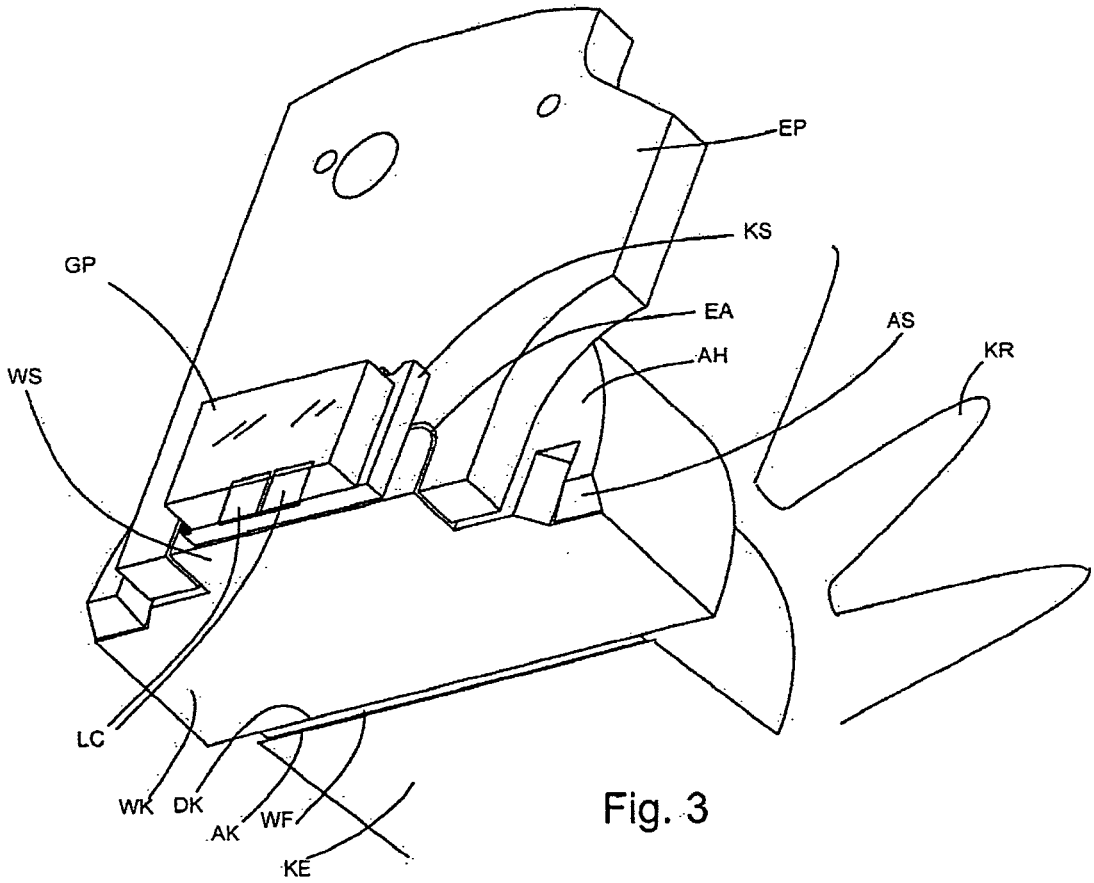
Figure 7:
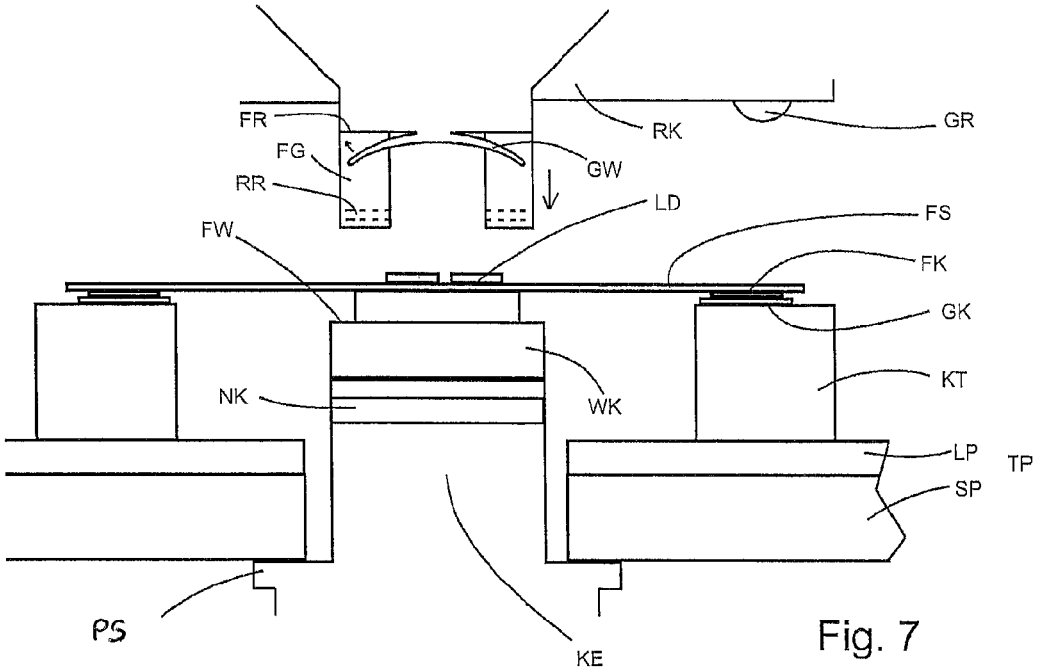
Figure 9:
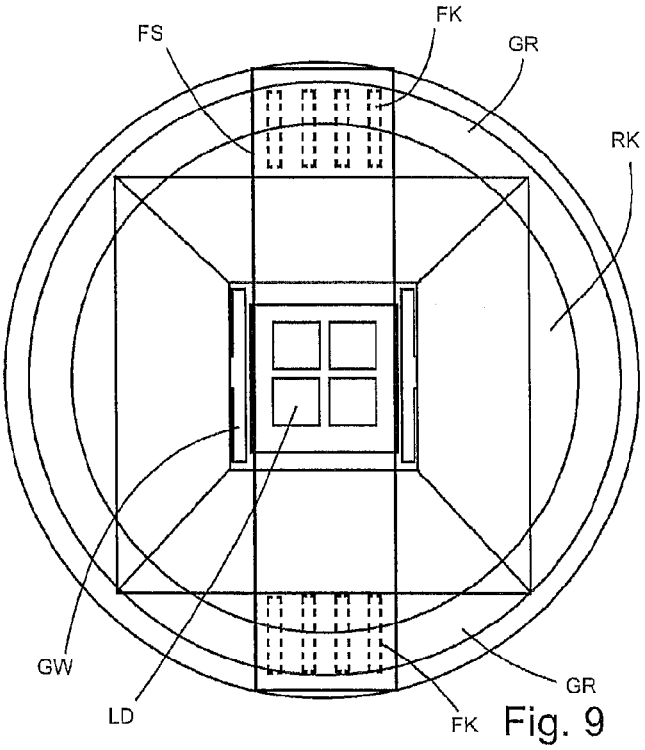
Figure 8:
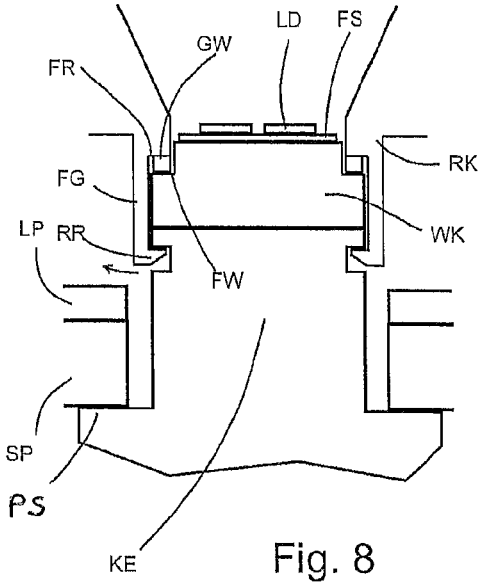
Figure 10:
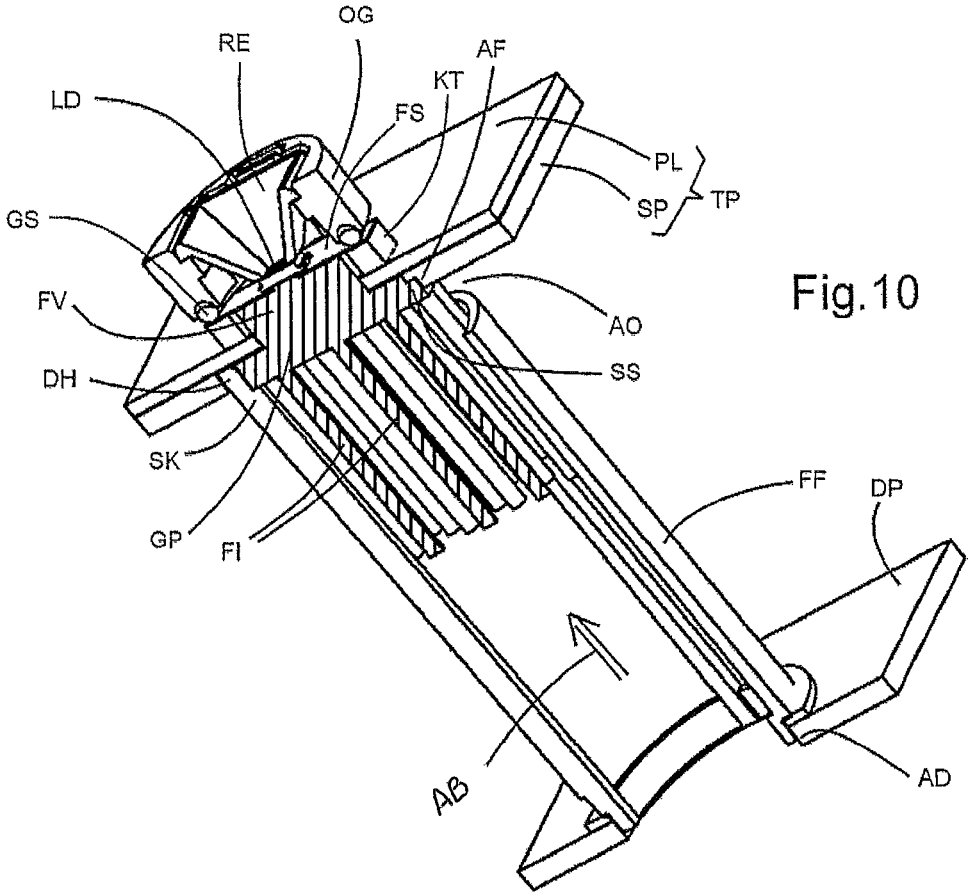

The invention is illustrated in more detail hereinafter on the basis of preferred exemplary embodiments with reference to the illustrations. Therein there are shown in:

FIG. 1 the front side of a carrier plate with light-emitting diode arrangements, FIG. 2 a light-emitting diode arrangement held on a cooling body, FIG. 3 an enlarged section of a light-emitting diode arrangement, FIG. 4 an alternative contact construction, FIG. 5 an overhead view of FIG. 4, FIG. 6 a screw fastening, FIG. 7 a side view of a further construction, FIG. 8 a side view turned relative to FIG. 7, FIG. 9 an overhead view of the arrangement according to FIG. 8, FIG. 10 an embodiment with press-on contacts.

FIG. 1 shows in oblique front elevation a view of a part of a floodlight, in which housing parts are removed and a carrier plate TP is illustrated in semi-cutaway manner. The carrier plate consists of a printed-circuit board LP and, stabilizing it mechanically, a bracing plate SP, which lie parallel to one another and possess approximately the same surface size. The printed-circuit board LP contains in particular conductor tracks for connection of a large number of light-emitting diode arrangements LA with electrical components, not illustrated in FIG. 1, of the floodlight. The printed-circuit board may be constructed as a rigid circuit board or as a flexible circuit-board substrate.

The light-emitting diode arrangements LA are arranged, preferably in regular distribution, on a surface, spaced apart from one another on the front side of the printed-circuit board LP facing toward the observer of FIG. 1. For clarity, the conductor tracks or further electronic details of the printed-circuit board LP and of the light-emitting diode arrangements LA are not also shown in FIG. 1.

On the rear side of the carrier plate TP facing away from the front side VS of the printed-circuit board, a large number of cooling bodies KK are provided as parts of a cooling device between the carrier plate TP and a cover plate DP spaced apart from it. The cooling bodies KK are surrounded by tubular bodies FR, which form individual flow channels for cooling air supplied from the rear side of the cover plate DP to each individual cooling body KK. The individual cooling bodies KK are in highly thermally conducting contact, in each instance, with one of the light-emitting diode arrangements LA, for which holes WA, through which parts of the cooling bodies KK and/or of the light-emitting diode arrangements project and are in highly thermally conducting contact with one another, are provided in the carrier plate. Hereby loss heat, which is produced during operation of the light-emitting diodes in the light-emitting diode arrangements LA, is transferred to the cooling bodies and absorbed from them by the air flowing past the cooling bodies in the flow channels and removed behind the carrier plate, preferably being dissipated into the environment.

Advantageously a lens arrangement and a cover plate, which for clarity are left out of FIG. 1, are also arranged spaced apart from the front side VS of the printed-circuit board LP.

FIG. 2 shows an advantageous arrangement of a cooling body KK and of the highly thermally conducting connection of such a cooling body with a light-emitting diode arrangement. FIG. 3 shows a cutaway view, enlarged compared with FIG. 2, of a section with a light-emitting diode arrangement on a cooling body.

The cooling body KK is illustrated in FIG. 2 as an elongated body with a solid core and cooling fins KR projecting radially from it. A cooling-air stream flows along the cooling fins between them from the end facing away from the light-emitting diode arrangement LA in the direction of the end of the cooling fins facing toward the light-emitting diode arrangement LA, where it emerges into the flow space common to all cooling bodies between the carrier plate TP and the cover plate DP. The shape of the cooling body sketched in FIG. 2 is to be understood merely as exemplary. The invention is not restricted to such cooling-body shapes.

A core KE of the cooling body projects in the direction of the light-emitting diode arrangement LA beyond the end of the cooling fins KR, where it forms, as can be seen from FIG. 3, a contact face AK, which is disposed opposite a mating face DK of the light-emitting diode arrangement LA. The contact face AK and the mating face DK form thermal-contact surfaces, via which heat transfer over the surface takes place from the light-emitting diode arrangement to the cooling body. Advantageously a thin thermally conducting layer of deformable, highly thermally conducting material, may be interposed between the oppositely disposed thermal contact faces AK, DK. The thermal-contact layer WF may be formed in particular by a customary thermally conducting foil. By the interposition of a deformable thermally conducting layer, surface irregularities on the thermal contact faces AK, DK can be evened out and a particularly good heat transmission between the two thermal contact faces can be achieved.

In the sketched exemplary case, the light-emitting diode arrangement advantageously contains a thermally conducting body WK of highly thermally conducting material, preferably of copper, via which loss power produced in the light-emitting diodes can be transferred very rapidly to a larger mass of the thermally conducting body WK and so especially load peaks can be controlled very well.

The light-emitting diode arrangement contains one or more semiconductor chips LC as active light-emitting elements. These are fastened, preferably soldered, to a highly thermally conducting substrate KS, which preferably consists of ceramic. The substrate KS in turn is connected highly thermally conductively over its surface with the thermally conducting body WK and in turn advantageously soldered with it, in order to impart a highly thermally conducting contact between the semiconductor chips LC and the thermally conducting body WK.

The substrate KS is for its part further connected with a circuit board EP, which serves for electrical contacting of the semiconductor chips LC with conductor tracks on the printed-circuit board LP. The circuit board EP possesses a hole EA, which surrounds a skirt-like extension WS of the thermally conducting body WK. The highly thermally conducting substrate KS is soldered onto this skirt WS. The connection of the substrate KS and of the circuit board EP may be achieved by soldering or cementing or other inherently customary joining techniques. For clarity, the electrical conductors for establishing electrical connections between the semiconductor chips LC and the circuit board EP are not also shown. The semiconductor chips LC are covered by transparent material GP, which may also be formed by a pane. On the side of the circuit board EP not visible in FIG. 3, first connecting parts, which can be fitted together detachably with second connecting parts on the printed-circuit board LP, are provided for a plug connection for the printed-circuit board LP, in order to connect the semiconductor chips to the conducting structure of the floodlight.

A detachable connection of the light-emitting diode arrangement LA with the cooling body KK by means of detachable mechanical holding means is indicated in FIG. 2 by a yoke HH which, being pivotable around a pivot shaft SA, is mounted pivotally on the core KE of the cooling body extending beyond the cooling vanes KR. The yoke HH may in particular be a wire yoke. In FIG. 2, the yoke HH is shown in an intermediate position. The curved double arrow next to the yoke HH shows the possible pivoting directions.

In the intermediate position illustrated in FIG. 2, the yoke HH rests with a yoke portion on an inclined surface AS of the thermally conducting body WK of the light-emitting diode arrangement and by further pivoting can be pivoted further, as far as a holding surface AH of the thermally conducting body WK facing away from the cooling body KK, into a holding position, in which it rests in self-holding manner by elastic bracing. Because of the elastic bracing of the yoke HH, which preferably can be provided by the construction of the yoke from an elastically deformable wire, the thermally conducting body WK is pressed with its mating face DK in the direction of the contact face AK of the cooling body, so that a good heat transmission between thermally conducting body and cooling body is assured. By overcoming a holding force, the yoke HH can be pivoted back from the holding position into the intermediate position illustrated in FIG. 2 and beyond this to a releasing position, in which the yoke, in viewing direction perpendicular to the front side of the printed-circuit board, no longer coincides with the light-emitting diode arrangement. In this releasing position of the yoke HH, the light-emitting diode arrangement can then be withdrawn from the printed-circuit board substantially perpendicularly to the front side of the printed-circuit board with simultaneous detachment of the plug connections between the circuit board EP and the printed-circuit board LP and replaced by a new light-emitting diode arrangement. FIG. 4 shows, in a side view, an exemplary embodiment in which, in a manner similar to FIG. 2, a light-emitting diode arrangement LA is fastened highly thermally conductively to a thermally conducting body WK and the thermally conducting body WK can be pressed by means of a pivotable elastic yoke HW against the end face of a cooling body projecting through an opening in the carrier plate TP and arranged on the rear side of the carrier plate. In the example according to FIG. 4, the pivotable elastic yoke has a singly or multiply cranked or angled portion ZA between the pivot shaft SA formed in the cooling body KE and the holding face AH of the thermally conducting body. Because of the angled portion, a substantially longer length of the yoke portion ZA is obtained compared with the shorter distance of the pivot shaft SA from the holding face AH, so that the yoke portion ZA, during pivoting into the holding position illustrated in FIG. 4, offers a large range of strain of the holding yoke radially to the pivot shaft SA and at the same time a high holding force in the holding position. Thus the yoke portion ZA can be advantageously guided closely along the outside surface of the thermally conducting body WK. The holding yoke HW can be constructed in particular as a bent wire, wherein the radial deformability and the holding force of the yoke portion ZA are adjustable precisely to the respective requirements via the wire diameter and the cumulative wire length over the portion ZA. A handle portion of the holding yoke HW is denoted by HG. The pivoting direction around the pivot shaft SA is indicated by a curved double arrow. The cumulative length of the portion ZA between the pivot shaft SA and the holding face AH of the thermally conducting body advantageously amounts to at least 1.5 times, preferably at least 2 times the shortest distance of the pivot shaft from the holding face. In the embodiment according to FIG. 4, the light-emitting diode arrangement contains a flexible module substrate FS, which is fastened to the thermally conducting body on the side of the thermally conducting body WK facing away from the cooling body KE. The flexible substrate FS contains conductor tracks, not illustrated individually, as well as, at its ends facing away from the light-emitting diodes LD, contact faces FK, which cooperate with mating contact faces GK of contact carriers KT arranged on the printed-circuit board LP in order to establish an electrical connection between the light-emitting diodes LD and the printed-circuit board LP. Preferably the contact faces FK are pressed by elastically biased means, not shown in FIG. 4, against the mating contacts GK. The means for pressing the contact faces FK against the mating contacts GK may in particular be part of a reflector housing of the light-emitting diode arrangement.

FIG. 5 shows an overhead view of an arrangement according to FIG. 4, without also illustrating the contact carriers KT in this diagram.

Instead of the illustrated holding means in the form of a pivotable and elastically deformable yoke, other embodiments of mechanically detachable holding means, which preferably also bring about a pressing-on of the thermal contact faces between thermally conducting body WK of the light-emitting diode arrangement and a cooling body arrangement, are also possible. In particular, a screw coupling of the light-emitting diode arrangement directly with the carrier plate TP or preferably with the cooling body KK or with another component of the floodlight structure may also be provided. In an advantageous embodiment of such a screw coupling, screws can be screwed through the light-emitting diode arrangement, especially through the thermally conducting body, into the cooling body or another component and actuated with a tool from the front side of the circuit board. Such an embodiment, in which fastening screws BS extend through a thermally conducting body WS and are screwed into threaded bores in the end face of a cooling body CB, in order to connect the thermally conducting body mechanically securely and highly thermally conductively with the cooling body, is sketched in FIG. 6. The light-emitting diodes LD are in highly thermally conducting contact with the face of the thermally conducting body WS turned away from the cooling body. A module circuit board MP forming a part of the light-emitting diode arrangement contains conductor tracks and bears a plug ST, which together with a socket BU on the circuit board PL forms an electric plug connection. The fastening screws BS are accessible from the front side VS of the circuit board PL, so that in this embodiment also a defective light-emitting diode arrangement can advantageously be replaced easily from the front side of the circuit board PL and therefore without detaching the carrier plate TP from the cover plate DP.

In yet another embodiment, the light-emitting diode arrangements may also be removed from or fitted onto the common printed-circuit board from its rear side, wherein it may also be provided that the light-emitting diode arrangements are already connected securely with cooling bodies during removal and fitting-on and together with these commonly form manipulable subassemblies.

A further embodiment is illustrated in different views in FIG. 7 to FIG. 9. In this embodiment it is provided that, analogously to the embodiment according to FIG. 4 and FIG. 5, the light-emitting diode assembly together with light-emitting diodes LD is preassembled together with a flexible substrate FS on a thermally conducting body WK and the thermally conducting body WK can be mounted on an end KE of a cooling body with good thermal conduction between the thermally conducting body WK and the end of the cooling body, wherein it may again be assumed that contacts FK, which can be brought into coincidence with mating contacts GK of a contact carrier KT on the conductor plate LT are provided on the outer ends of the flexible substrate FS facing away from the light-emitting diodes LD. For the secure mechanical fixation of the light-emitting diode arrangement with the thermally conducting body WK on the end KE of the cooling body, it is provided in this exemplary embodiment that recesses, for example in the form of grooves NK, are provided on oppositely disposed side faces of the end KE of the cooling body. A clamp that can be mounted from the light emission side has latching structures RR, which are provided for detachable engagement in the grooves NK. In the sketched example, a reflector body RK, which can form a reflector, flaring in the manner of a funnel in the emission direction, for the light emitted by the light-emitting diodes LD, or which can hold such a reflector, is provided as the holding clamp. In an advantageous embodiment, the reflector body RK can be formed as an injection-molded plastic part. In the case of the latching structures RR engaging in the grooves NK, the holding clamp acts by pressing in such a way between the thermally conducting body WK and the end KE of the cooling body that elastically deformable spring elements GW, which in the snapped-on condition of the reflector body illustrated in FIG. 8, are elastically deformed against an internal restoring force and hereby press the thermally conducting body WK with the restoring force against the end face of the end KE of the cooling body, are interposed between thermally conducting body WK on the one hand and the reflector body RK forming the holding clamp on the other hand. In a first advantageous embodiment, for example, the spring elements GW can be formed by elastomeric bodies, for example in strip or cord form, which are interposed between contact faces FW of the thermally conducting body and mating contact faces FR of the holding clamp. The contact faces FW and the mating contact faces FR preferably lie substantially in planes perpendicular to the direction of the fitting together of the reflector body RK with the end KE of the cooling body. In another advantageous embodiment, the spring elements are formed by bendingly deformable, especially strip-like spring tongues which, as indicated in FIG. 7, can be molded onto the holding clamp or the reflector body or inserted as separate springs between holding clamp and thermally conducting body. In the embodiment visible in FIG. 8, free ends of the spring elements GW are braced against the contact face FW of the thermally conducting body WK and are elastically bent over in the direction of the mating contact face FR during pushing-on of the holding clamp, as is indicated by an arrow in FIG. 7. Various other embodiments are conceivable for the construction and arrangement of spring elements for generating a force pressing the thermally conducting body WK against the end KE of the cooling body.

In the example according to FIG. 7 to FIG. 9, the end KE of the cooling body and the thermally conducting body WK pressed against the end face of the cooling body are assumed to have substantially square contour, but this does not restrict the generality. To the contrary, other contour shapes are also possible for the end KE of the cooling body and/or the thermally conducting body WK.

An internal hole, in the exemplary case once again assumed to be square, in which the light-emitting diode arrangement is inserted, is provided in the reflector body RK. The flexible substrate FS projects beyond the thermally conducting body WK on two oppositely placed sides, and the reflector body RK is open in these two lateral directions. The latching structures RR are provided only on two oppositely disposed sides of the thermally conducting body WK that are offset by 90° from the penetration through the flexible substrate.

The latching structures RR are preferably detachable non-destructively with access from the front side of the conductor plate LP assigned to the light-emission direction. In the sketched example, the latching structures are provided on elastically deformable spring tabs FG of the reflector body projecting in the direction of the cooling body. For detachment of the latching engagement, such spring tabs FG can be bent outward by means of a tool, as indicated by a curved arrow in FIG. 8. Additional auxiliary structures, by means of which a simplified detachment of the latching structures RR from the grooves NK is possible, may also be provided on the reflector body.

Advantageously the holding clamp, which in the sketched example is the reflector body RK, simultaneously with the snapping-on to the end KE of the cooling body serves to press the contacts FK of the flexible substrate FS against the mating contacts GK on the conductor plate or the contact carriers KT. For this, pressing means, which in the sketched example may be provided by elastically deformable further spring elements GR, are advantageously provided on a side of the reflector body RK assigned to the conductor plate. The further spring elements GR may be formed, for example, by a ring of elastic material inserted in a groove on the side of the reflector body assigned to the conductor plate. Such an elastic ring GR is indicated above the contacts FK in FIG. 9. Because of the structure of the spring element GR as a ring, a commercial O-ring may be advantageously used and handled in simple manner by insertion into an annular groove of the reflector body RK during assembly.

The situation before the mounting of the reflector body RK forming the holding clamp is illustrated in FIG. 7, where the thermally conducting body WK is already positioned in correct position on the end face of the end KE of the cooling body. Centering structures may be predefined between thermally conducting body WK and end KE of the cooling body. The push-on direction is indicated by a straight arrow.

Starting from the assembly drawing according to FIG. 7, the reflector body RK together with latching structures RR, which embrace the thermally conducting body WK on both sides and during pushing-on are spread laterally against the spring force of the spring tabs FG, is pushed on over the thermally conducting body WK and the end of the cooling body, and in the last phase of the push-on movement the spring elements GW are elastically deformed against a restoring force until the latching structures RR snap into the grooves NK. At the same time, the further spring elements GR press on the top side of the flexible substrate in the last phase of the push-on movement and cause a press-on force between the contacts FK and the mating contacts GK. The force acting on the cooling body during pushing-on of the reflector body RK is absorbed by mechanical means, not illustrated, which brace the cooling body, via its own peripheral structure PS or indirectly via other mechanical means, against the rear side of the carrier plate or the stable bracing plate forming one part of same. The force pressing the cooling body in the direction of the bracing plate SP may be generated, for example, via a cover plate DP in the way described for FIG. 1 or in some other manner familiar in itself to the person skilled in the art.

The formation of a holding clamp as a reflector body RK is of special advantage. However, the holding clamp may also be formed in other ways and in particular may also be formed by a bent resilient sheet-metal part. In particular, it may also be provided that an additional component, which advantageously is held in the same way against the end KE of the cooling body by a holding clamp pressing the light-emitting diode arrangement against the end KE of the cooling body and projects laterally beyond the thermally conducting body as far as the contact points and while undergoing elastic deformation exerts the pressing force on the contacts, is interposed for pressing the contacts FK against the mating contacts GK. In particular, a holding clamp may also be formed in the manner of the exemplary embodiment of FIG. 2, FIG. 4 and FIG. 5 as a wire yoke with resilient deformability for generation of a press-on force. Holding clamp and element for pressing on the contacts may also be realized in turn in a single component, which is different from the reflector body.

FIG. 10 shows an embodiment in which a light-emitting diode arrangement LD with a flexible substrate FS is fastened on an end portion FV of a cooling body, for example cemented by means of a highly thermally conducting cement. In this exemplary embodiment it is provided that the light-emitting diode arrangement LD together with the flexible substrate FS will be fastened securely on the cooling body before installation in the floodlight and the end FV of the cooling body together with the light-emitting diode arrangement will be guided through an opening in the carrier plate TP from the rear side of the bracing plate SP by elastic bending-over of the flexible substrate FS. The cooling body is braced against a step AF of the bracing plate SP and by means of a tube FF serving for guidance of a cooling-air stream QF, for example, and a cover plate DP facing away from the carrier plate TP opposite the light emission direction, is pressed against the bracing plate SP.

After passage of the end FV of the cooling body through the opening in the carrier plate, the flexible substrate FS is able to spread out again and the contacts on the flexible substrate are brought to coincidence with mating contacts on contact carriers attached to the conductor plate PL. A mounted body OG, in which a reflector RE is arranged, is snapped together with the end FV of the cooling body via latching structures, not illustrated in detail in FIG. 10, located concealed behind the visible components, the latching connection preferably again being detachable non-destructively. In this embodiment a replacement of the light-emitting diode arrangement is possible only by detachment of carrier plate TP and cover plate DP from one another and removal of the cooling body from the rear side of the carrier plate. The fastening of the mounted body OG on the end of the cooling body assigned to the light-emitting diode arrangement is mechanically particularly advantageous and requires no additional connection elements, for example on or in the carrier plate.

In the sketched example, the cooling body GP has a large number of cooling fingers FI, which face away from the light-emitting diode arrangement LD and around which the cooling air stream AB blown in through an opening AD in the cover plate DP flows, in order to dissipate the loss heat to the cooling stream, which emerges through a lateral opening AO of the tube FF, and to guide it away in a space behind the bracing plate SP. The guide tube FF is braced via bracing elements DH and step structures SK on the cooling body GP and/or the carrier plate TP.

A spring element GS, preferably an encircling ring of elastically deformable material which, by undergoing elastic deformation while the mounted body is being fastened to the end FV of the cooling body GP, presses the ends of the flexible substrate FS together with the electrical contacts against the mating contacts of the contact carrier KT and in this way assures a particularly advantageously simple contacting, is provided on a side of the mounted body OG assigned to the conductor plate LP.

The features in the foregoing and those specified in the claims as well as apparent from the illustrations are advantageously realizable both individually and in various combinations. The invention is not restricted to the described exemplary embodiments but may be modified in various ways within the scope of know-how of those skilled in the art.

The invention claimed is:

1. Floodlight with a large number of light-emitting diode arrangements (LA) as light sources which, in a lighting panel, are arranged distributed over a surface and spaced apart from one another on a common printed-circuit board (LP) and are electrically contacted with this, wherein the light-emitting diode arrangements each contain at least one light-emitting diode on a flexible substrate (FS) and wherein the flexible substrates (FS) can be individually fixed in their position relative to the printed-circuit board (LP) by means of detachable mechanical holding means (HH) in a holding position of the holding means and with holding means released can be detached from the printed-circuit board or fitted onto it and electrically contacted in solder-free manner with conductor tracks of the common printed-circuit board, wherein the circuit board has an opening in the region of the light-emitting diode arrangements, and wherein the light emitting diode arrangements, together with a cooling body arrangement, pass through said opening.

2. Floodlight according to claim 1, wherein the holding means can be actuated from the front side of the printed-circuit board associated with the light emission direction and wherein the light-emitting diode arrangements can be removed or inserted from the front side of the printed-circuit board after detachment of the holding means.

3. Floodlight according to claim 1, wherein the holding means can be shifted between a holding position and a releasing position.

4. Floodlight according to claim 1, wherein a cooling body arrangement (KK), which is connected highly thermally conductively with the light-emitting diode arrangements (LA), is provided on the rear side of the printed-circuit board facing away from the light-emitting diode arrangements.

5. Floodlight according to claim 4, wherein the cooling body arrangement contains a large number of cooling bodies (KK) associated individually with a respective light-emitting diode arrangement (LA).

6. Floodlight according to claim 4, wherein the holding means (HH) in the holding position act between cooling body arrangement (KK) and light-emitting diode arrangements (LA).

7. Floodlight according to claim 6, wherein the holding means (HH) in the releasing position are held on the cooling body arrangement (KK).

8. Floodlight according to claim 6, wherein the holding means in the holding position press cooling body arrangements (KK) and light-emitting diode arrangements (LA) against one another at oppositely disposed thermal contact faces (AK, DK).

9. Floodlight according to claim 8, wherein a deformable thermally conducting layer, especially a thermally conducting foil (WF), is interposed between the oppositely disposed thermal contact faces (AK, DK).

10. Floodlight according to claim 1, wherein the light-emitting diode arrangements respectively contain a thermally conducting body (WK), to which the light-emitting diodes dissipate loss heat power.

11. Floodlight according to claim 10, wherein the thermally conducting bodies (WK) are in highly thermally conducting contact with the cooling body arrangement (KK).

12. Floodlight according to claim 1, wherein the light-emitting diode arrangements (LA) can be removed from the printed-circuit board substantially perpendicular to the plate surface thereof when holding means (HH) are in releasing position.

13. Floodlight according to claim 1, wherein the light-emitting diode arrangements (LA) are detachably connected electrically via plug connections with conductor tracks of the printed-circuit board (LP).

14. Floodlight according to claim 1, wherein contacts (FK) of the light-emitting diode arrangements (LA) can be pressed via elastic press-on means against mating contacts connected with the printed-circuit board.

15. Floodlight according to claim 14, wherein the press-on means are held detachably on the associated cooling bodies.

16. Floodlight according to claim 15, wherein the press-on means are structurally integral with the holding means.

17. Floodlight according to claim 1, wherein the printed-circuit board (LP) is connected with a bracing plate (SP) that stabilizes it mechanically.

18. Floodlight according to claim 1, wherein the holding means (HH) can be actuated manually, preferably without tools.

19. Floodlight according to claim 1, wherein the holding means (HH) are held captively on the cooling body arrangement (KK).

20. Floodlight according to claim 1, wherein the holding means (HH) in the holding position bear on mating faces (AS) of the light-emitting diode arrangements (LA) pointing away from the front side of the printed-circuit board.

21. Floodlight according to claim 1, wherein the holding means (HH) are mounted pivotally around a pivot shaft (SA).

22. Floodlight according to claim 21, wherein the holding means (HH) are formed by pivotable yokes, especially elastically deformable wire yokes.

23. Floodlight according to claim 21, wherein the holding means (HH) can be pivoted away between the holding position and the releasing position across the light-emitting diode arrangement (LA).

24. Floodlight according to claim 1, wherein the holding means contain screws.

25. Floodlight according to claim 1, wherein the cooling body arrangement is supported on a step (AF) of the support plate (SP).

* * * * *